US005671800A

United States Patent [19]

Sulzer et al.

[11] Patent Number: 5,671,800

[45] Date of Patent: Sep. 30, 1997

[54] INJECTOR FOR CASTING METAL STRIP

[75] Inventors: John Sulzer; Olivo Giuseppe Sivilotti; Ronald Roger Desrosiers, all of Kingston, Canada

[73] Assignee: Alcan International Ltd., Kingston, Canada

[21] Appl. No.: 456,780

[22] Filed: Jun. 1, 1995

Related U.S. Application Data

[63] Continuation of Ser. No. 278,849, Jul. 22, 1994, Pat. No. 5,636,681.

[51] Int. Cl.[6] ..... B22D 11/10

[52] U.S. Cl. ..... 164/434; 164/439; 164/440; 222/606

[58] Field of Search ..... 164/480, 481, 164/482, 489, 437, 439, 440, 430, 431, 432, 433, 434, 158; 222/591, 606

[56] References Cited

U.S. PATENT DOCUMENTS

| | | | |
|---|---|---|---|
| 3,795,269 | 3/1974 | Leconte et al. | 164/158 |
| 3,976,117 | 8/1976 | Olsson | 164/48 |
| 3,976,119 | 8/1976 | Miller . | |
| 4,421,154 | 12/1983 | Smith | 164/158 |
| 4,785,873 | 11/1988 | Lauener . | |
| 4,972,900 | 11/1990 | Szczypiorski | 164/437 |

FOREIGN PATENT DOCUMENTS

| | | |
|---|---|---|
| 1182617 | 2/1985 | Canada . |
| 0139966 | 5/1985 | European Pat. Off. . |
| 0424837 | 5/1991 | European Pat. Off. . |
| 59-218244 | 12/1984 | Japan . |
| 60-180647 | 9/1985 | Japan . |
| 62-110843 | 2/1987 | Japan . |
| 1133649 | 5/1989 | Japan . |
| 3077748 | 4/1993 | Japan . |

*Primary Examiner*—Scott A. Smith
*Assistant Examiner*—Randolph S. Herrick
*Attorney, Agent, or Firm*—Cooper & Dunham LLP

[57] ABSTRACT

Process and apparatus for continuous casting of metal strip in which a layer of liquid parting agent, and any solid detritus contained therein, is completely removed from a casting surface of a rotating belt after contact with the metal, and in which a new layer of liquid parting agent is applied to the casting surface thereafter and prior to renewed contact with the molten metal. The removal of used parting agent and the application of fresh helps to present the formation of surface blemishes and defects on the cast metal strip product. Such blemishes and defects can also be minimized by using an injector having a flexible tip used to inject the molten metal onto the casting surface and preferably one or more spacers to create a gap between the tip and the casting surface itself. The spacer is preferably a screen of wire strands orientated to minimize disruption of the new layer of liquid parting agent applied to the casting surface. By avoiding disruption of the new layer of liquid parting agent, surface blemishes on the cast product are minimized. The invention also relates to the molten metal injector having a flexible tip and optionally provided with spacer elements.

3 Claims, 3 Drawing Sheets

INJECTOR FOR CASTING METAL STRIP

This is a continuation of application Ser. No. 08/278,849 filed Jul. 22, 1994, now U.S. Pat. No. 5,636,681.

BACKGROUND OF THE INVENTION

I FIELD OF THE INVENTION

This invention relates to a process and apparatus for continuously casting metal strip. More particularly, the invention relates to the continuous casting of metal, such as aluminum (including aluminum alloys), copper, steel or other metals using one or more moving surfaces in the form of heat conducting belts, rolls, wheels or caterpillar block and in particular are conveniently constituted by a pair of flexible heat-conducting bands or belts, such as metal belts in twin belt casters.

II DESCRIPTION OF THE PRIOR ART

Although the continuous casting of metal strip has been under development for many years, and many improvements have been made (see for example improvements to guiding, stabilizing and cooling in twin belt casting apparatus in U.S. Pat. No. 4,061,177 to Sivilotti), difficulty is still encountered in obtaining finished metal products of high surface quality at economical prices.

A particular problem is that the surface appearance of the cast products is easily degraded due to several factors encountered during the casting process. For example, a parting layer is normally applied to the casting surfaces to permit the cooled product to be separated from the casting surfaces. However, if the parting layer is not applied very uniformly, different areas of the surface of the product may have different appearances. Moreover, after contact with the molten metal, the surfaces of the casting surfaces may become contaminated with detritus from the metal and parting agent, and the presence of such material may affect the appearance of the product.

Surface problems can also be caused as the molten metal is applied to the moving casting surfaces. This is usually achieved by means of an injector that extends over the operating width of the casting surfaces, but, problems arise unless the injector is spaced from the moving casting surface by a precise small distance. However, methods of maintaining such a distance without contact with the moving casting surface are not very accurate, are not sufficiently reliable (due to mechanical and thermal distortions which can permit metal flashback for example) and methods using contacts with the moving casting surfaces usually disrupt the layer of parting agent applied to the casting surface or cause premature solidification of the metal in the injector due to heat transfer to the belt.

There is accordingly a need for improvements in such casting processes and apparatus to overcome such defects in the finished products and such unreliability of operation.

SUMMARY OF THE INVENTION

An object of the present invention is to improve the quality of metal strip products produced by continuous casting methods, particularly belt casting methods.

Another object of the invention is to enable a discharge outlet of an injector used for casting metal to be held a precise and uniform distance from a casting surface without detriment to the cast product.

Another object of the invention is to provide improved apparatus for casting metal strip, especially belt casting metal strip.

Yet another object of the invention is to provide an improved injector for use in apparatus for producing cast metal strip.

A still further object of the invention is to overcome problems encountered during continuous strip casting of metals.

According to one aspect of the invention, there is provided a process of continuously casting metal strip, comprising: continuously injecting molten metal into a mould having at least one casting surface that is continuously recirculated through the mould, and removing a strip of solidified metal delivered from the mould following cooling of the metal. A layer of a parting agent uniformly continuously applied to the at least one casting surface before the casting surface is contacted by the molten metal in the mould. All of the parting agent, and any detritus contained in the parting agent, are continuously removed from the at least one casting surface after the casting surface emerges from the mould but before the surface undergoes application of further parting agent prior to further contact with molten metal in the mould.

The continuous injection of molten metal into the mould is preferably by means of a flexible tip containing a discharge outlet for the molten metal. This tip conforms to the shape of the casting surface passing the tip. The flexible tip may bear directly against the parting layer on the casting surface or it may bear against the casting surface via at least one spacer that maintains a predetermined spacing from the casting surface while avoiding perturbations in the layer of parting agent on the casting surface that cause deterioration of the surface appearance of the metal strip.

According to another aspect of the invention, there is provided a process of continuously casting metal strip, comprising: continuously injecting molten metal into a casting mould formed between continuously moving casting surfaces of rotating opposed belts and removing a strip of solidified metal delivered from the mould following cooling of said metal. A layer of a parting agent uniformly continuously applied to the casting surfaces before the casting surfaces contact the molten metal; and substantially all of said parting agent, and any detritus contained in said parting agent, are continuously removed from the casting surface emerging from the mould before the casting surface undergoes application of further parting agent prior to contact with the molten metal.

According to another aspect of the invention, there is provided a process of continuously casting metal strip, comprising: forming a casting mould between a pair of opposed moving belts, each of which has a casting surface continuously recirculated through said mould; forming a layer of a parting agent on the casting surfaces; continuously injecting molten metal onto the casting surfaces carrying the layer of parting agent from an injector having a flexible tip containing a discharge outlet for the molten metal; maintaining the tip of the injector at a predetermined spacing from the casting surfaces to prevent flash back of metal between the tip and the casting surfaces while avoiding perturbations in the layer of parting agent on the casting surface that result in deterioration of surface appearances of strip formed by the process; and removing solidified metal strip delivered by the belts from the mould following cooling of the metal, According to another aspect of the invention, there is provided apparatus for continuously casting metal strip, comprising: a mould for casting a metal strip, comprising at least one casting surface that, in use, is continuously recirculated through the mould; an injector for injecting molten metal into the mould; an applicator for applying a uniform layer of parting agent onto the casting surface prior to entry of the casting surface into the mould; and removal apparatus for substantially completely removing the parting agent, and any detritus contained therein, from the casting surface downstream of the mould but upstream of the applicator; the removal apparatus acting to prevent parting agent previously passed through the mould on the casting surface, and detritus contained therein, from contacting further molten metal injected into the mould.

In the above apparatus, the injector preferably has a flexible tip containing an outlet for the molten metal. At least one spacer is positioned between the tip of the injector and each of the casting surfaces for maintaining a predetermined spacing between the discharge outlet and the casting surfaces to prevent, in use, flashback of molten metal between the tip and the casting surfaces while avoiding perturbations in a layer of the parting agent applied on the casting surfaces that result in deterioration of surface appearances of a strip of solidified metal produced by the apparatus.

According to another aspect of the invention, there is provided a molten metal injector for a continuous casting machine having at least one moving casting surface onto which molten metal is injected by the injector. It comprises: a pair of spaced refractory members having inner faces forming an injector channel with an upstream metal entry portion and a flexible tip containing a downstream metal outlet; and at least one spacer positioned at the tip to bear, in use, against the casting surface and to maintain a predetermined separation between the discharge outlet and the casting surface to prevent flash back of molten metal between the tip and the casting surface while avoiding perturbations in a layer of the parting agent applied on the casting surface that result in deterioration of surface appearances of a strip of solidified metal produced by the apparatus.

According to another aspect of the invention, there is provided apparatus for continuously casting metal strip. It comprises: one or more continuously moving surfaces forming a metal mould; and an injector for delivering molten metal from a discharge outlet to the moving surfaces, the injector having a flexible tip containing an outlet for the molten metal; wherein the flexible tip conforms to the shape of the casting surfaces and wherein there is at least one spacer positioned between the flexible tip of the injector and the casting surfaces for maintaining a predetermined spacing between the discharge outlet and the casting surface to prevent, in use, flashback of molten metal between the tip and the casting surfaces while avoiding perturbations in a layer of parting agent applied on the casting surface that result in a deterioration of surface appearance of a strip of solidified metal produced by apparatus.

According to another aspect of the invention, there is provided apparatus for continuously casting metal strip, which comprises: at least one continuously moving casting surface forming a metal mould; and an injector for delivering molten metal from a discharge outlet to the at least one casting surface, the injector having a tip containing an outlet for the molten metal; wherein the tip is flexible to conform to the shape of the at least one casting surface.

According to still another aspect of the invention, there is provided a molten metal injector for a continuous casting machine having a moving casting surface onto which molten metal is injected by the injector, comprising: a pair of spaced refractory members and a pair of side members, the members having inner faces forming an injector channel with an upstream metal entry portion and a tip containing downstream metal outlet; the refractory members and the side members being at least in part flexible such that the tip, in use, conforms under a metallostatic load to the surface shape of the moving casting surface.

While the processes and apparatus of the invention can be used for a wide variety of casting processes for the continuous casting of metal strip, including single and twin roll casters, block or caterpillar casters, wheel casters, wheel-belt casters and twin belt casters, they are particularly applicable to casters where at least one casting surface is formed by a moving belt, and in particular to twin belt casting processes and apparatus.

The belts used in moving belt casters must be maintained at relatively low temperatures to prevent thermal distortion of the surfaces and therefore create substantial temperature gradients between the belts and the molten metal. Thus problems of thermal control at the injector tip become most critical with such casters and the controlled contact and spacing achievable in the injector of the present invention is particularly advantageous.

The processes and apparatus can be applied to a wide variety of parting layers, including liquid, powder and mixed (powder in liquid) parting layers, but they are particularly applicable to liquid parting layers.

Liquid parting layers are most frequently used with various belt casting apparatus and processes where the lower temperatures permit effective use of liquids.

The aspect of the invention which provides for application and removal of parting layers may be used with liquid parting agents on wheel-belt casters (such as Secim casters) but is particularly useful in twin-belt casting.

Flexible tips may be used either in direct contact with the casting surface, or separated from the casting surface by spacers. In either case they may be used with or without a parting layer.

One particular embodiment which uses a flexible tip which directly contacts the parting layer on the casting surfaces of a twin belt caster provides a process suitable for many metals and alloys.

However, for metallic products with critical surface requirements a flexible tip spaced from the parting layer is preferred.

The processes and apparatus are useful most particularly in twin belt casting using relatively smooth steel or copper belts.

Although not limited to any particular metal, the process and apparatus of this invention are particularly useful for the casting of relatively low melting point metals e.g. aluminum and aluminum alloys, and are particularly suited for casting "long freezing range" alloys that are particularly susceptible to the forming of surface defects and damage.

DETAILED DESCRIPTION OF THE PREFERRED EMBODIMENTS

The present invention is mainly, but by no means exclusively, concerned with twin belt casters, e.g. of the type shown in U.S. Pat. No. 4,061,177 to Sivilotti, the disclosure of which is incorporated herein by reference. The following disclosure relates to twin belt casters of this kind to exemplify the process and apparatus of the invention.

In a preferred embodiment of the present invention, use is made of a liquid parting agent, usually consisting of a mineral oil or a mixture of synthetic and vegetable oils, that is applied to the casting surface of the casting belts before molten metal is deposited on the surface by a metal injector. The parting agent, when contacted by the molten metal, develops gases that reduce any tendencies of the solidified metal to adhere to the belt and also provides a measure of thermal insulation for the casting surface. A layer of solid particles, e.g. graphite or talc, is traditionally used for this purpose, or a mixture of particles in a liquid, but a liquid is preferred in the present invention to avoid surface contamination of the metal product by the parting agent material.

In order to avoid difficulties caused by the inevitable build up of detritus in the parting agent during its contact with the molten metal, the parting layer is, according to one aspect of the present invention, completely removed from the casting surface of the belt after separation of the metal product from the casting surface and before the application of a fresh layer of parting agent and further molten metal.

Figure 1:
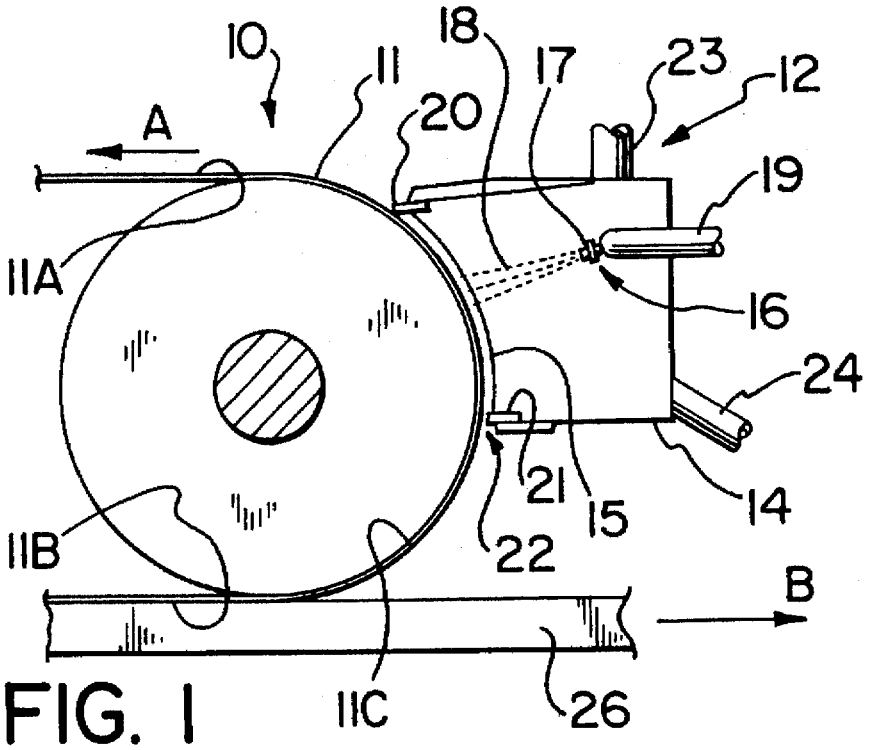
FIG. 1 is a simplified cross-section of part of a belt casting machine showing parting layer removal apparatus according to one aspect of this invention.

This can be achieved by apparatus of the type shown in FIG. 1 of the accompanying drawings. A part of an upper belt 11 at one end of a twin casting machine 10 is shown in the figure. The surface 11A of the belt moves in the direction of arrow A towards an injector (not shown) for applying a layer of molten metal. The metal solidifies as a slab 26 in contact with return surface 11B moving in the direction of arrow B. A portion 11C of the belt 11 is newly released from contact with the solidified metal strip and has a surface coating of a parting liquid contaminated with detritus following contact with the hot metal. A new layer of liquid parting agent is applied to the casting surface 11A of-the belt at a station (not shown) upstream of the injector for applying the molten metal layer.

A parting layer removal apparatus 12 is positioned adjacent to the belt 11 for the purpose of completely removing the old parting agent and detritus from the surface of the belt before the fresh new parting agent is applied. The removal apparatus 12 consists of a hollow casing 14 extending across the width of the belt and closed on all sides except at an open side 15 facing an adjacent surface of the belt 11. A spray bar 16 with flat spray nozzles 17 is positioned within the casing 14 and directs a high pressure (preferably 500–1000 p.s.i., 3400–6900 KPa) curtain spray 18 of a cleaning liquid (preferably a non-flammable and easily separable mixture of 30% by volume of kerosene and 70% by volume of water) approximately normal to the belt surface from a pressurized supply pipe 19. The spray of cleaning liquid removes most of the parting liquid and contaminating detritus from the surface of the belt as the belt moves past the removal apparatus 12. Any remaining liquid or solid on the belt surface is removed by a scraper 20, made of a flexible or preferably elastomeric material, e.g. nylon, silicone rubber or Buna-N, oriented at about 45° to the belt tangent and forming a seal at the upper end of the open side 15 of the casing and bearing against the belt under pressure to act as a squeegee.

The lower edge 21 of the casing 14 is spaced from the surface of the belt by a gap 22 just large enough to allow the adhering solid detritus on the belt surface to enter the apparatus 12 without becoming trapped under the edge of the casing and thus without causing any damage to the belt. For most applications, the gap 22 is kept between 0.015 and 0.025 inches (0.4 to 0.6 mm). The cleaning liquid is prevented from leaving the casing 14 through the gap 22 by virtue of an incoming stream of air drawn into the casing by reduced pressure (e.g. 15 inches of water) developed within the casing. The reduced pressure is created by a vacuum pump (not shown) which withdraws air from the interior of the casing via a pipe 23. Most preferably, the casing is sealed by flexible edges against the moving belt surface at all places except the lower edge 21 to maximize the ingress of air at the lower edge.

Used cleaning fluid and contaminants that collect in the casing are removed via a barometric drain pipe 24 to a reservoir (not shown) and the used material may then be filtered and recirculated.

A similar belt (not shown) provided with a similar parting agent removal apparatus is provided immediately below the apparatus as shown to provide the second part of the twin belt caster.

The removal apparatus 12 makes it possible to remove a contaminated layer of parting liquid and solid detritus from the belt surface quickly, efficiently and continuously so that the casting surface of the belt 11 emerging from the moving mold is completely clean and ready for the application of a fresh new layer of parting liquid before receiving molten metal once again.

For proper operation of the belt caster, the new parting liquid layer must be applied thinly and uniformly across the width of the belt. The thickness of the liquid layer should normally be in the range of 20 to 200 $\mu g/cm^2$ for steel belts, or 20 to 500 $\mu g/cm^2$ for copper belts, and should vary across the width of the belt by only about ±5% (i.e. maximum 10% variation). Layers having such specifications can be produced by various means, e.g. by reciprocating air atomizing spray guns followed by brushes to even out the coating or by doctor blades. However, such systems have shortcomings; the spray guns and brush system because it is not known how much parting liquid is applied to the belt, as not all of it adheres to the belt, and the doctor blade system because the amount of parting liquid applied is a function of the set-up of the blade, the viscosity of the oil and a dependence on the texture of the belt. Parting layers of different compositions may be applied to the upper and lower belts if desired, and layers of different thickness used as well.

Figure 2:
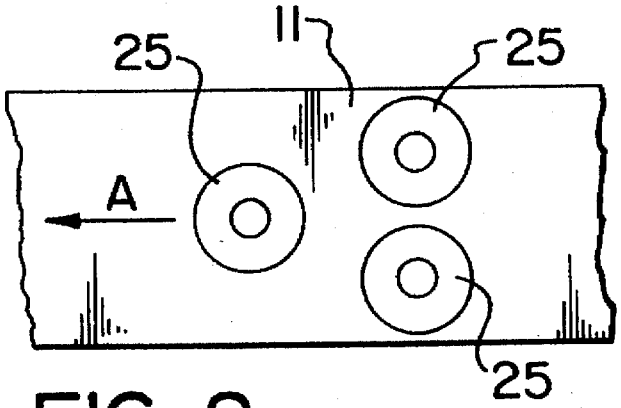
FIG. 2 is a simplified plan view of apparatus used for applying a new layer of parting agent to a casting surface of a casting machine.
Figure 3:
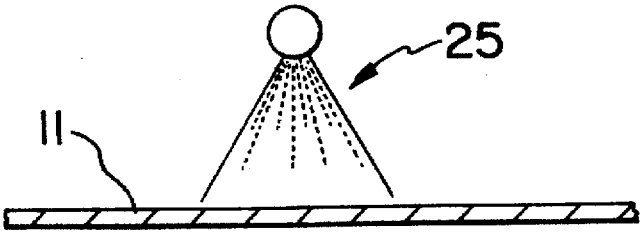
FIG. 3 is a simplified longitudinal vertical cross-section of the apparatus of FIG. 2.

These problems can be avoided by using non-contacting electrostatic spray devices 25 as represented in simplified form in FIGS. 2 and 3. These devices may be, for example, modified versions of electrostatic rotary atomizers sold by Electrostatic Coating Equipment (Canada) Limited, each consisting of one or more rotating bells turning at speeds up to 50,000 r.p.m. and held at potentials up to 100 KV. Into these bells is metered the parting liquid to be sprayed using for example, an electric gear pump. The amount of parting liquid may be varied by changing the liquid flow rate from the gear pump.

By arranging electrostatic spray devices along the belt in overlapping echelon as shown in FIG. 2, a uniform application of the parting liquid across the width of the belt can be achieved. The actual distribution of the liquid can be measured in preliminary runs using small metal tokens attached across the belt. Removal and precise weighing of the tokens reveals the spray distribution so that the spray devices can be adjusted for uniform spraying, if necessary.

Following application of the parting liquid to the belt surface, the belt receives a layer of molten metal from a molten metal injector and the metal is cast between two opposing belt runs that define a moving casting mould between them, in the usual manner of a twin belt caster.

Figure 4:
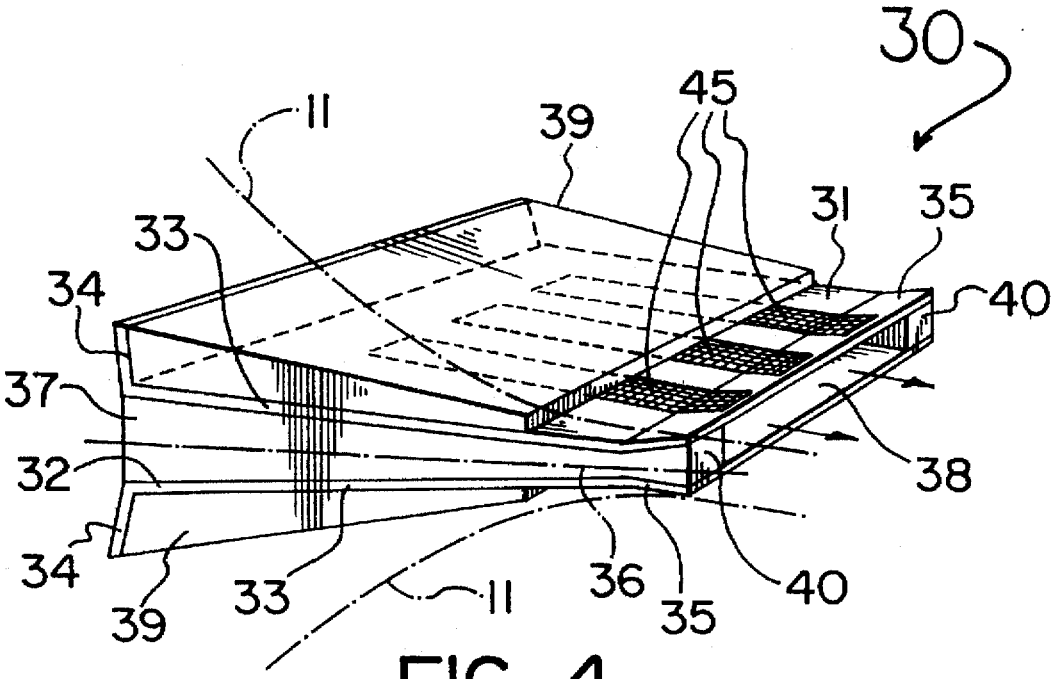
FIG. 4 is a perspective view of a metal injector exemplifying a further aspect of this invention.
Figure 5A:
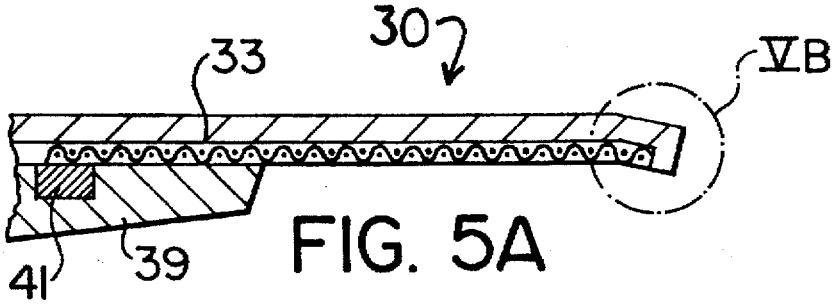
FIG. 5A is a partial longitudinal cross-section of part of the injector of FIG. 4.
Figure 6:
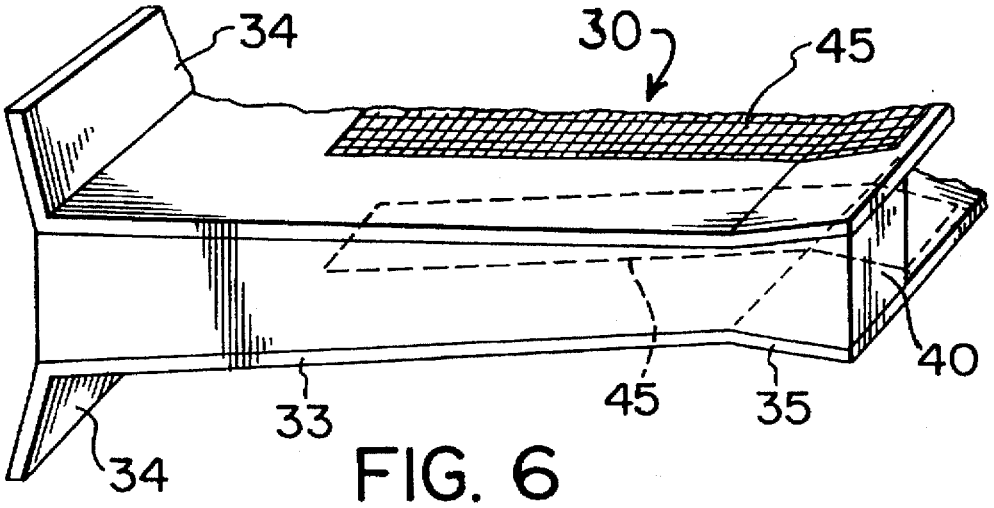
FIG. 6 is an enlarged partial perspective view of the injector of FIG. 4.

In a preferred aspect of the present invention, the injector is designed to minimize disturbances in the new parting liquid layer on the belt surface as it passes the injector and to minimize disturbances in the flow of molten metal from the injector to the belt. An injector 30 of this kind is shown in FIGS. 4, 5 and 6 of the accompanying drawings.

The material from which the injector is preferably formed is a thermally insulating refractory material which is not wetted by molten metal and is resistant to the elevated temperatures normally encountered in metal casting. For casting molten aluminum and aluminum alloys, a suitable material is available commercially from Carborundum of Canada Ltd., as product number 972-H refractory sheet, preferably as the 5 mm thick material. This is a felt of refractory fibers typically comprising about equal proportions of alumina and silica and usually containing some form of rigidizer, e.q. colloidal silica, such as Nalcoag® 64029. In ready-to-use form, the felt is impregnated with a solution containing colloidal silica.

Each refractory member making up the injector may be formed by placing the refractory felt containing the solution of colloidal silica, in a forming die and compressing the felt in the die to the desired shape. In this form the felt is heated, either by using a preheated die or by placing the die in a furnace to form the felt into a rigid mass.

The heating of the felt is typically carried out at a temperature of about 200° C. for one hour.

It has been found that the long dimensions of the refractory members are subject to shrinkage on subsequent heating to casting temperatures and this has caused certain problems. It has been discovered that the material becomes surprisingly dimensionally stable when heated to about 600° C. for one hour before assembly into an injector. This is referred to as a thermal stabilisation treatment and is typically carried out with the refractory members placed on a flat refractory board.

The strength of the injector structure can be significantly improved by adding layers of glass cloth mesh on the exterior surface at the upstream end or by embedding glass cloth in the structure at critical locations.

The methods of manufacture of the injector, as described, are particularly suited to cast aluminum and its alloys. Other metals, especially those melting at higher temperatures require ceramic materials of higher refractory properties and of adequate chemical and mechanical resistance to the metal being cast. These ceramic materials are well known to those skilled in the art of continuous casting and have been the subject of extensive development work in the ceramic industry, so that each specific casting application could use materials best suited to contain the molten metal being cast, with the best range of properties (mechanical strength and insulation values) for each case. The materials however, should preferably be in fibrous form, and capable of being bonded in plate-like geometries, with the same flexibility considerations as noted above.

At the high end of the refractory scale, carbon fibres are available, which may be carbon bonded to form composite structures; to prevent oxidation, these structures require inert gas shields. Other materials, such as high alumina or zirconia fibres are refractory and inert at high temperatures and can be bonded with high temperature refractory binders. Similarly fibres based on nitride refractories, spinels or sialons can be used in these structures as well. Non-wettability is also of importance in these structures, and boron nitride can be used (frequently as a coating because of cost) to achieve this.

As will be seen from FIG. 4, a preferred injector is formed by a pair of spaced generally rectangular upper and lower refractory members 31 and 32 made of the indicated material. These refractory members are generally identical, each being formed with a main flat portion 33, an outwardly flared flange portion 34 at the metal entry end and a slightly outwardly flared portion 35 at the discharge outlet end.

The refractory members 31 and 32 are shown in operational position in FIG. 4 with the inner faces of members 31 and 32 converging from the metal entry portion, reaching a minimum separation at a throat portion 36. The slight outward flares 35 extend from the throat 36. Arranged in this manner, the refractory members 31 and 32 form between them a channel having a metal entry portion 37 and a metal discharge outlet portion 38. The refractory members 31 and 32 are attached at their edges to side member 40. These refractory members 31 and 32 are preferably supported over at least part of their length by rigid support members 39 which can be formed from a variety of materials, e.g. refractory silica or cast iron plates. The support members 39 carry most of the load and maintain the dimensional features for the upstream and mid-length areas of the injector. However, in the narrow throat 36 and the discharge 38, i.e. at the tip of the injector, the refractory members become the main structural components of the injector without any backing support. For this portion each refractory member 31, 32 constitutes a bridge between the backing support 39 and the top of the nozzle, wherein the tip of the nozzle is supported by the belt. As such it is restrained from rotational moments over the support member and subject to a vertical reaction by the belt, as a result of the continuous loading from the metal pressure which it supports.

The injector tip is compliant with the casting surface in that it is sufficiently flexible when under metallostatic load to maintain a contact with the casting surface, either directly or more preferably via spacers. The maximum deflection of the unsupported portion of the refractory tip of specific size under a metallostatic load is determined by the moment of inertia of the member and its rigidity. The moment of inertia in turn is dependent on the third power of the thickness of the tip material.

Thus it becomes evident that control over the thickness of the refractory members is most important because the deflection varies with the cube of the thickness. Also the modulus of rigidity of the refractory members is important and is influenced by the amount of rigidizer present in the felt and whatever may be added later, e.g. after compression forming. Good control over the deflection is maintained by compression forming of the felt to the correct predetermined thickness, and by heating and curing the rigidizer in the felt while holding it in the die in compressed form.

The injector is best shaped as shown in FIGS. 4 and 6, namely, tapering the channel inwardly from the metal entry portion 37 to a minimum thickness at the throat 36. This reduces the metallostatic head losses by undue friction losses as the metal flows through the injector. In other words, the injector is restrictive to flow only where necessary, i.e. in the minimal area of the throat 36. This configuration then dictates a slight outward flare or angle break in the refractory member to diverge the injector gap downstream of the throat in order to provide a metal seal of the refractory member downstream edge with the belt. This outward flare also serves to improve the rigidity of the bridge portion of the refractory member. The preferred angle of outward flare is in the range of 1° to 8° depending on the placement of the downstream refractory member edge relative to the cavity opening.

The entry portion flange 34 can conveniently be at an angle of about 90° to the flat portion 33 of the refractory member 32 and this serves as a convenient means of locking the refractory members to the support members against being pulled into the caster cavity.

The preferred practice in constructing the injector is to staple or bond the top and bottom refractory members 31 and 32 into the tapered shape via edge strips 40 that conform to the desired shape. These edge members may be cut from Pyrotek® N-14 rigid refractory board. To ensure that the injector conforms to the casting surface, the downstream portion of the member is made compliant for example through the use of 1.6 mm (1/16 inch) strips of low density refractory Fibrefrax® sheet between the edge member and the upper and lower members at the point of attachment. Internal spacers serve to hold the refractory members apart at the metal entry end of the injector and it is not usually necessary to do the same toward the discharge end because the metallostatic pressure is usually sufficient to force the downstream end of the injector apart and against the belts. However, if it should be deemed important to provide spacers near the downstream end, they should be placed upstream of the throat so that they will not cause turbulence in the metal flow of the downstream edge of the injector, particularly at high metal feed rates. Such turbulence can affect the surface quality of the cast strip. Also, when placed upstream of the throat, the spacers are retained inside the injector by the convergent shape toward the throat. The spacers should be streamlined in the direction of metal flow in order to cause minimum metal disturbance to metal approaching the belts.

The flexible injector has the advantage that it can conform to a casting surface and mould to the shape of that surface under the metallostatic head of metal, thus ensuring consistent and reliable metal containment. In some applications (e.g. non-critical surface applications) the injector can thereby lie directly on the casting surface and "seal" to the surface even if a parting agent is used. However, where parting layers are used to achieve critical surface properties and in particular where liquid parting agents are used in twin belt casting applications, it is important that the discharge end of the injector be held at a small uniform distance from the casting surface so as not to disturb the layer of parting agent. In practice, a suitable spacing is generally in the range of 0.1 to 1 mm, and preferably between 0.2 and 0.7 mm, the optimum spacing depending on the metallostatic head and other casting parameters. The provision of such a spacing also has the advantage of avoiding tip wear and excessive heat losses from the metal through the refractory member to the belt, which may result in the freeze-up of metal in the narrow throat area of the injector, or at least freezing of metal onto the leading edges of the injector, either of which are causes for a stoppage in the process. In conventional practice, this spacing is achieved by making the injector relatively inflexible and holding it spaced from the belt. However, if the nozzle is made inflexible, the gap varies with time if the belt becomes uneven in the transverse or longitudinal directions, and this may result in "flash back" of the molten metal between the injector tip and either belt (if the gap becomes too large) or alternatively undue heat loss and disruption of the parting layer (if the tip touches the belt). This problem is overcome according to a further aspect of the present invention by providing a more flexible and conforming injector and using spacers to separate the discharge end of the injector from the belt. However, spacers of this kind, which bear against both the injector and the belt, commonly have the disadvantage of disrupting the layer of parting agent before the metal is applied to the casting surface or of marking or scoring the belt surface itself. Both effects may result in a loss of quality of the finished surface of the metal. Moreover, if the spacers are made too large in the lateral direction, excessive heat may be conducted through the spacers to the belt, thus resulting in metal freeze in the outlet of the injector.

In a preferred form of this further aspect of the present invention, these disadvantages are overcome by using thin strips 45 of metal wire screen material as spacers on the underside of the lower injector member 32 and the topside of the upper injector member 31 and extending to the discharge end of the injector so that the screen material separates the injector from the belt and maintains the desired spacing. The spacers can be conveniently fixed to rigid bars 41 located within the support members 39 and cut to the exact length required.

The preferred screen structure is asymmetric, with the wires running in the casting direction having more ample bends or thicker gauge than those running in the transverse direction. The more ample bends are usually obtained when the wire mesh is constructed of unequal strand density in the directions parallel to and transverse to the casting direction, with a higher strand density in the direction transverse to the casting direction. The transverse wires are therefore somewhat hidden inside the cross section of the screen, i.e. they do not make contact with the belt surface. The contact points are established only where the longitudinal wires are bent to accommodate the crossings of the straighter transversal wires and the spacing effect obtained when using such screens is between two to three times the wire diameters. As an example, a stainless steel screen made of 0.011 inch diameter wires, 14 wires per inch in the longitudinal direction and 18 wires per inch in the transverse direction, produces a 0.027 inch spacing effect, i.e. the longitudinal wires protrude 0.005 inch more than the transversal wires and consequently provide the only contact points with the mould, even after lengthy casting runs during which slight amounts of wear are induced on the contact wires by rubbing friction with the moving belt. A wire mesh of this type can be obtained, for example, from Crooks Wire Products of Mississauga, Ontario, Canada.

Figure 7:
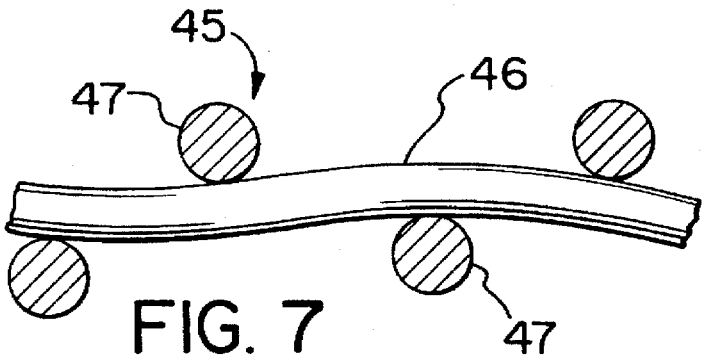
FIG. 7 is a transverse cross-sectional view of a mesh spacer of a type that can be used with the injector of FIG. 4.

FIG. 7 is a representation of a cross-section of a mesh spacer 45 of the above type. Wires 46 of the mesh arranged transversely to the casting direction undulate only slightly to accommodate wires 47 arranged in the casting direction. Wires 47 consequently undulate in a more pronounced manner to accommodate wires 46 and form the highest and lowest points of the screen.

Figure 5B:
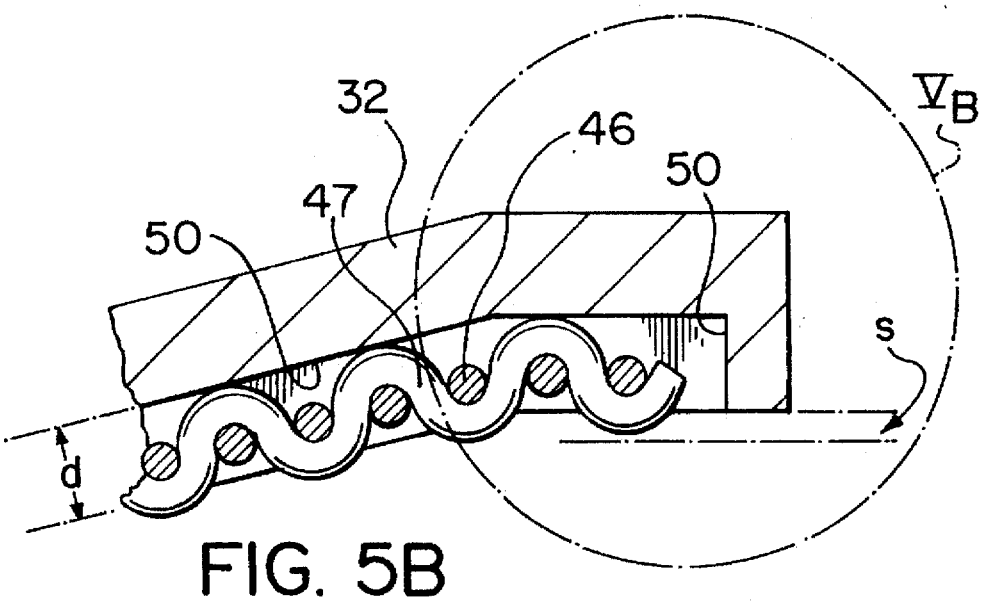
FIG. 5B is an enlargement of the part of FIG. 5A encircled by broken line $V_B$.

Referring to FIG. 5B, because the wire mesh overall thickness d generally exceeds the desired gap, the injector tip may be provided with an inset 50 which ensures that the mesh thickness is accommodated while the desired gap s between the tip and the casting surface is maintained. Inset 50, being slightly larger than the screen spacer, also accommodates the different expansion of wire and tip.

Figure 8:
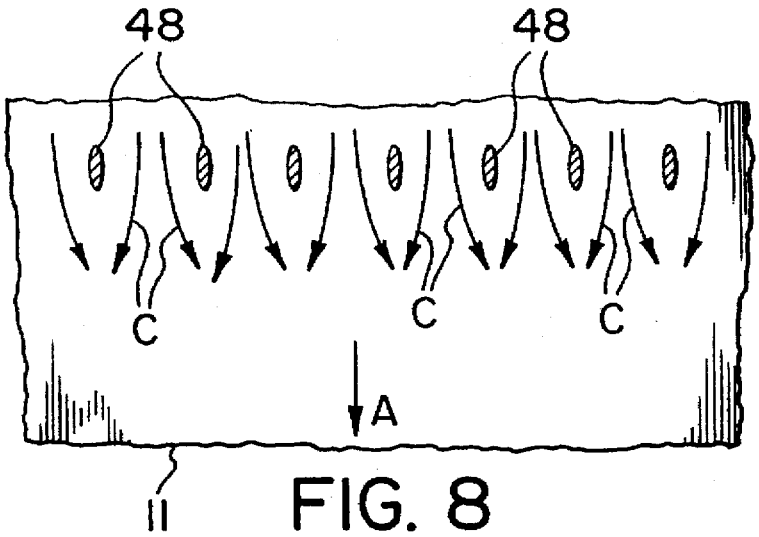
FIG. 8 is a plan view of a casting surface showing points of contact of a mesh spacer of the type shown in FIG. 7.

As shown in FIG. 8, when the screen is used as a spacer, only the outermost points of wires 47 contact the casting surface with longitudinally-orientated elliptical footprints 48. Liquid parting agent on the surface of the belt 11 flows around the wires 47 in a non-turbulent, laminar fashion and the liquid layer quickly re-forms itself uniformly as shown by arrows C.

Since the wires in contact with the belt run in the casting direction, the points of contact with the mould surface are so small and narrow that their effect on the surface of the cast product is completely invisible, even when casting long-freezing-range alloys which have a tendency of showing lines of blebs or other streaky defects when the belt surface is disturbed by any scraping contact. Apparently, any "ploughing" that results from the contact of the longitudinal wires is so fine that no scraping effect is produced and the liquid parting layer remains uniform as it was before the contact took place. In general, it can therefore be stated that any disturbance produced in the layer of liquid parting agent is negligible from the point of view of producing adverse effects on the surface quality of the resulting cast product. While this healing mechanism is most effective with a liquid parting layer, because the wire contacts have little impact on the surface, the mechanism is to some extent useful in liquid-powder and powder parting layers.

Another important advantage of this aspect of the invention derives from the fact that heat from the injector has to travel along the wires to go from the points of contact with the refractory tip of the objector to the points of contact with the belt, which (considering the longitudinal wires as sinusoidal waves) are half a wavelength away from the former contact points. This drastically reduces the heat flow that would be present if solid metal strips were used as spacers. In practice, temperature measurements at the back of the tip near the downstream edge where the screen spacers are in contact with the mould and in the equivalent points between spacers fail to show significant differences.

The screen spacers, of the mesh size and wire diameter described above, are preferably 1 inch wide and are preferably located at 2 inch centres across the casting width of the objector. They are attached to the fixed support structure and extended in the casting direction to about ¼ inch short from the downstream edge of the refractory tip.

Screen spacer strips are used for convenience of installation and replacement after use, when wear of the wires at the contact points with the belt reaches a maximum limit. However a continuous screen across the entire casting width may alternatively be used, if desired, for example to maximize the cycle between replacements when very high metallostatic pressures are employed, because the screen structure accommodates thermal expansion differentials without significant warping which may result in localized excessive contact pressure and wear and, in extreme cases, in loss of reliability and accuracy of the spacing function as it has been found to occur sometimes with solid spacers.

Further advantages of the screen spacer are that, while the points of contact with the belt are small, the weight of the injector is distributed over the considerable width of the spacers and so the actual loading on each wire 47 can be kept is reasonable. Therefore, there is no observable scoring of the belt by the spacer. Further, the screen spacer is very flexible, so that it easily follows the contours of the belt surface. Coupled with the use of a flexible injector, as described above, this means that the gap between the tip of the injector and the belt surface can be kept uniform at all times. The casting process therefore is very reliable and proceeds smoothly at the tip of the injector.

While the spacer used in the present invention is preferably a woven wire screen, as indicated above, a similar effect could be obtained by using a series of parallel wires oriented in the casting direction and attached to the lower surface of the tip of the injector. Such an arrangement however makes it less convenient to replace the spacer, when worn, and can cause difficulty when aligning the individual wires during the initial installation. The use of a woven wire mesh is therefore strongly preferred.

While preferred embodiments of the various aspects of this invention have been described in detail above, it will be apparent to persons skilled in the art that various modifications and alterations may be made without departing from the spirit of the invention. All such variations and modifications form part of this invention.

What we claim is:

1. A molten metal injector for use in a continuous casting machine having at least one moving casting surface of varying surface shape onto which surface molten metal is injected by said injector, the injector comprising:

a pair of spaced refractory members and a pair of side members, said members having inner faces forming an injector channel with an upstream metal entry portion and a tip containing a downstream metal outlet;

said channel tapering inwardly from said metal entry portion towards said metal outlet to form a throat adjacent to said tip and said refractory members flaring outwardly from said throat to said metal outlet to an angle in the range of 1°to 8°;

said refractory members and side members being at least in part flexible such that the tip in the outlet region, in use, conforms under a metallostatic load to a surface shape of said at least one moving casting surface.

2. An injector according to claim 1 further comprising at least one spacer positioned at said tip to bear, in use, against said at least one casting surface and to maintain a predetermined separation between said discharge outlet and said casting surface to prevent flash back of molten metal between said tip and said casting surface.

3. An injector according to claim 2 wherein said at least one spacer comprises a wire screen having intersecting wires arranged longitudinally and transversely of said casting surface, and in which only the longitudinal wires project from upper and lower surfaces of the screen to avoid perturbations in a layer of parting agent applied on the casting surface that result in deterioration of surface appearance of a strip of solidified metal produced by said apparatus.

* * * * *